United States Patent [19]

Barnes

[11] Patent Number: 4,671,229

[45] Date of Patent: Jun. 9, 1987

[54] OIL TEMPERATURE CONTROL DEVICE

[76] Inventor: Lee Barnes, Box 239, Kit Carson, Colo. 80825

[21] Appl. No.: 846,352

[22] Filed: Mar. 31, 1986

[51] Int. Cl.[4] ..... F01M 1/00

[52] U.S. Cl. ..... 123/196 AB; 184/104.3

[58] Field of Search ..... 123/196 AB, 41.33; 184/104, 6.22

[56] References Cited

U.S. PATENT DOCUMENTS

| | | | |
|---|---|---|---|
| 4,027,643 | 6/1977 | Feenan et al. | 123/196 AB |
| 4,367,699 | 1/1983 | Evans | 123/41.33 |
| 4,512,300 | 4/1985 | DeVore | 123/196 AB |
| 4,520,767 | 6/1985 | Roettgen et al. | 123/41.1 |

*Primary Examiner*—E. Rollins Cross

*Attorney, Agent, or Firm*—Norman B. Rainer

[57] ABSTRACT

Apparatus compatible with existing internal features of the engine block of an air-cooled gasoline driven internal combustion engine provides improved control of the temperature of the engine's lubricating oil. The apparatus utilizes a temperature-sensing wax servomotor and a piston positioned thereabove within an elongated circular cylindrical chamber. The upper extremity of the chamber communicates with a branching site of an oil conducting conduit where a first branch leads to an oil cooler device and a second branch avoids the cooler device. When the oil in the crankcase is hotter than desired, the servomotor forces the piston upwardly to cause closure of the second branch.

5 Claims, 1 Drawing Figure

OIL TEMPERATURE CONTROL DEVICE

BACKGROUND OF THE INVENTION

This invention relates to apparatus for controlling the temperature of lubricating oil circulating within an internal combustion engine, and more particularly concerns valve apparatus which senses the temperature of said oil and routes the oil to cooling means in response to overly high sensed temperatures.

Air-cooled gasoline-operated internal combustion engines of 4 cylinders, as used in automobiles such as the Volkswagon Beetle, generally utilize oil cooling means interposed between an oil-circulating pump and the crankshaft in a closed loop pressurized oil-circulating system. When the oil is at temperature below about 170 degrees F., it is circulated directly to the valves, bearings, and other moving parts requiring lubrication and within the circulation path of the oil. When the oil temperature rises above about 170 degrees F., an oil flow valve mechanism associated with the crankcase of the engine diverts the flow of oil to a shunt path leading through cooling coils and then back to the general oil circulation path. One reason for cooling the oil is that, at elevated temperatures, the viscosity of the oil drops to levels where it loses its lubricating characteristics; and furthermore, the elevated temperatures produce unwanted vaporization and molecular decomposition of the oil.

The conventional oil flow valve mechanisms utilized in the aforesaid engines act in accordance with pressures sensed within the oil system. In general, when the temperature of the oil rises, the pressure within the oil system decreases. Based upon such interrelationship between oil temperature and pressure, conventional oil flow valve mechanisms utilize a piston slidably positioned within a cylinder having a sealed lower portion that communicates with the engine crankcase, and an upper extremity that opens into the oil conduit line leading toward the crankshaft. By virtue of such arrangement, the piston is subjected to a differential pressure which causes it to move either upwardly toward the open extremity of the cylinder, or downwardly toward the sealed extremity. When the cylinder is in its uppermost position, in intrudes into the oil line, sealing off a path of oil flow leading directly to the crankshaft while at the same time diverting flow to an oil cooler whose output is directed toward the crankshaft.

Although said conventional oil flow valve mechanisms are of simple construction, they are not reliably accurate in controlling oil temperature because they operate indirectly based upon a pressure-sensing principle; and various engine, oil and weather factors can alter the pressure-temperature interrelationship.

U.S. Pat. No. 4,512,300 to DeVore, et al discloses an oil temperature control valve which utilizes a wax servomotor immersed in the oil being monitored and having a plunger whose axial position is dependent upon the oil temperature. When extended, the plunger is capable of closing and/or opening pathways of oil flow. However, the DeVore valve requires a very specially constructed housing and associated interactive components.

It is accordingly an object of this invention to provide apparatus for sensing and controlling the temperature of lubricating oil in an engine.

It is another object of this invention to provide apparatus as in the foregoing object readily adaptable to air cooled gasoline-operated internal combustion engines of current design.

It is a further object of the present invention to provide apparatus of the aforesaid nature of rugged and durable construction amenable to low cost manufacture.

These objects and other objects and advantages of the invention will be apparent from the following description.

SUMMARY OF THE INVENTION

The above and other beneficial objects and advantages are accomplished in accordance with the present invention by apparatus comprising:

(a) an elongated circular cylindrical chamber associated with an air-cooled gasoline driven internal combustion engine, said chamber having a closed bottom portion and open upper extremity, said bottom portion communicating with the engine crankcase, permitting transfer of lubricating oil therebetween, (b) a temperature-sensing wax servomotor seated in the bottom portion of said chamber and having a plunger whose axial position is temperature-dependent, said plunger having a first extremity housed within said servomotor, and a second, free extremity disposed above said servomotor and directed toward said open upper extremity of the chamber, (c) a piston in slidable engagement with the upper portion of said chamber, said piston having an upper extremity adapted to be located at variable distances above said open upper extremity, and a lower extremity which rests in abutment with the free extremity of said plunger, and (d) conduits for the directed flow of lubricating oil, said conduits having a branching site from which a first branch leads to an oil cooler device and a second branch avoids said cooler device, said branching site being accessible to the upper extremity of said piston, whereby (e) the position of said piston is determined by the position of said plunger acting against the pressure differential across said piston caused by exposure of the piston to the pressures in the crankcase and conduits, and (f) in its uppermost position, representing maximum temperature conditions, the piston closes said second branch of the conduits.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
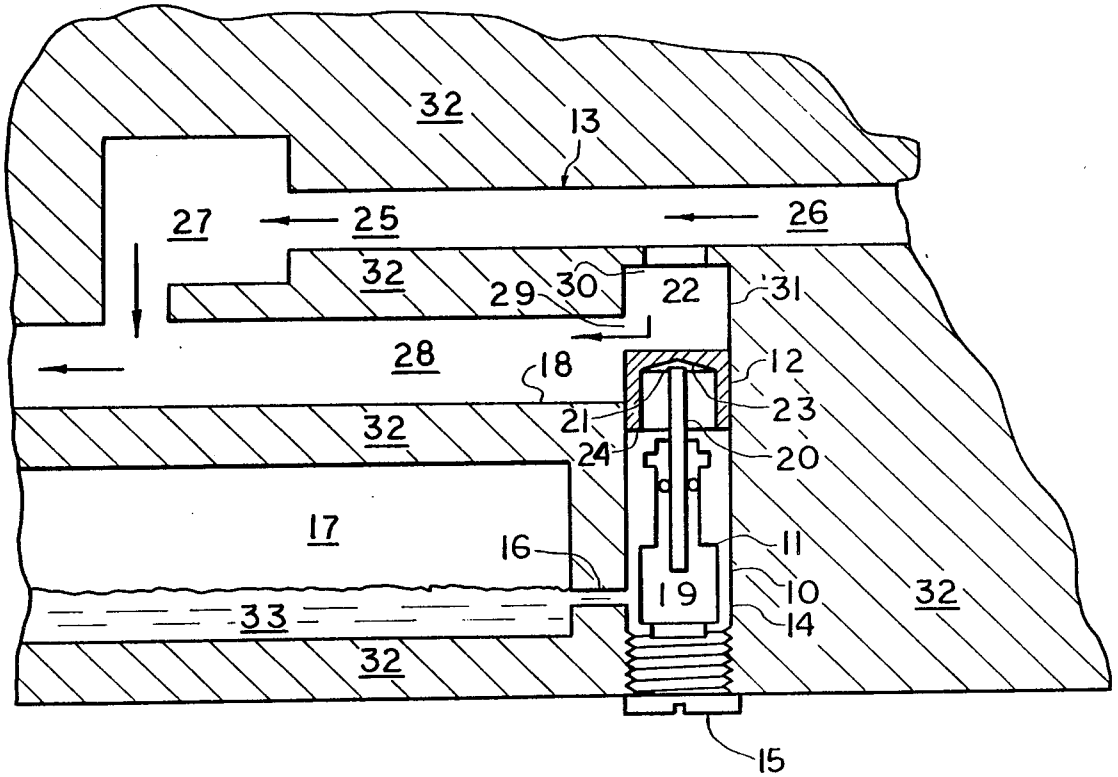
FIG. 1 is a schematic side view of an embodiment of the apparatus of this invention.

For convenience of description, the terms, "upper" and "lower", or expressions of equivalent import will have reference to the upper and lower portions, respectively, of the embodiment shown in FIG. 1.

DESCRIPTION OF THE PREFERRED EMBODIMENT

Referring to the drawing, an apparatus of the present invention is shown generally comprised of chamber 10 which accommodates wax servomotor 11 and piston 12, and conduit structure 13 located above said chamber.

The chamber is of elongated circular cylindrical configuration, and is generally a pre-existing feature of Volkswagon air-cooled engines, associated with engine block 32 for the purpose of controlling oil temperature by means of a coil spring interactive with a pressure-sensing piston. To install the apparatus of the present invention, said coil spring is removed. The chamber has a bottom portion 14 sealable by threaded plug 15. An aperture 16 in the sidewall of the chamber adjacent bottom portion 14 communicates with oil reservoir 33 in crankcase 17. The chamber is further defined by open upper extremity 18.

Wax servomotor 11 is comprised of housing 19 and plunger 20 vertically centered within said housing and protruding therefrom to free upper extremity 21. Suitable wax servomotors which may be utilized in the apparatus of this invention are readily available. The housing is adapted to fit within chamber 10 and rest upon threaded plug 15. rest upon threaded plug 15.

Piston 12 is bounded by upper surface 22, lower surface 23 and cylindrical sidewall 24 which slidably engages chamber 10. Lower surface 23 is adapted to reside in abutment with upper extremity 21 of said plunger. Centering means may be provided within said lower surface to accommodate said plunger.

Conduit structure 13 is comprised of supply tube 26 leading from the engine's oil pump, passageway 25 which conveys lubricating oil from supply tube 26 to oil cooler device 27, and passageway 28 which directs oil from supply tube 26 to the main oil gallery of the engine. Supply tube 26 and passageways 25 and 28 interconnect at a branching site represented by control port 29. An inwardly disposed flange 30 is disposed above said control port and above extension wall 31 which represents a continuous integral extension of the cylindrical wall of chamber 10. By virtue of such configuration and arrangement of components, piston 12 can be driven upwardly so as to seat upon flange 30, thereby occluding port 29. When such occlusion occurs, all the oil from supply tube 26 will be routed or shunted to oil cooler 27 and thence to the main oil gallery. When the piston is in a lowered position, a minor portion of the total oil flow will flow directly to the main oil gallery, and a major portion will be sent indirectly to the main oil gallery by way of the oil cooler.

In the operation of the apparatus, the temperature of the oil in the crankcase is sensed by the wax servomotor partially immersed in crankcase oil which enters chamber 10 by natural leakage around the piston and exits through sidewall aperture 16. High temperatures cause plunger 20 to rise, thereby forcing piston 12 upward until it initially partially constricts flow through control port 29, and eventually totally occludes flow through said port. In such valve-like operational manner, when the oil in the crankcase is hotter than desired, cooling is initiated. The pressure differential across the piston serves to return it to its lower position.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. Apparatus for controlling the temperature of lubricating oil comprising:

(a) an elongated circular cylindrical chamber associated with an air-cooled gasoline driven internal combustion engine, said chamber having a closed bottom portion and open upper extremity, said bottom portion communicating with the engine crankcase to permit transfer of lubricating oil therebetween, (b) a temperature-sensing wax servomotor seated in the bottom portion of said chamber and having an elongated plunger whose axial position is temperature-dependent, said plunger having a first extremity housed within said servomotor, and a second, free extremity disposed above said servomotor and directed toward said open upper extremity of the chamber, (c) conduits for the directed flow of lubricating oil, said conduits having a branching port from which a first branch leads to an oil cooler device and a second branch avoids said cooler device, (d) a piston in slidable engagement with the upper portion of said chamber, said piston having an upper extremity configured to occlude said branching port, and a lower extremity resting in abutment with the free extremity of said plunger and experiencing the fluid pressure within said crankcase, whereby a pressure differential exists between the upper and lower extremities of the piston, whereby (e) the position of said piston is determined by the axial position of said plunger acting against said pressure differential, and (f) in its uppermost position, representing maximum temperature conditions, the piston occludes said branching port, thereby closing said second branch of the conduits.

2. The apparatus of claim 1 wherein said chamber is located within the engine block of said engine.

3. The apparatus of claim 2 wherein the bottom portion of said chamber has an aperture which communicates with said crankcase.

4. The apparatus of claim 3 wherein the bottom portion of said chamber is sealed by a threaded plug which permits removal and entrance of said servomotor into said chamber.

5. The apparatus of claim 4 wherein centering means are provided within the lower extremity of said piston to accommodate the free extremity of said plunger.

* * * * *